US007683750B1

(12) United States Patent
Yu

(10) Patent No.: US 7,683,750 B1
(45) Date of Patent: Mar. 23, 2010

(54) WARNING DEVICE FOR CIRCUIT BREAKER

(76) Inventor: Tsung Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 0 days.

(21) Appl. No.: 12/423,011

(22) Filed: Apr. 14, 2009

(51) Int. Cl.
*H01H 71/04* (2006.01)

(52) U.S. Cl. ..... 337/79; 337/66; 200/314

(58) Field of Classification Search ..... 200/314; 337/37, 66, 79
See application file for complete search history.

(56) References Cited

U.S. PATENT DOCUMENTS

| | | | | | |
|---|---|---|---|---|---|
| 2,496,759 | A * | 2/1950 | Warsher | 337/76 |
| 4,056,816 | A * | 11/1977 | Guim | 340/638 |
| 4,342,979 | A * | 8/1982 | Phillips | 337/41 |
| 4,630,020 | A * | 12/1986 | Yang | 337/79 |
| 4,633,240 | A * | 12/1986 | Guim et al. | 340/638 |
| 4,768,025 | A * | 8/1988 | Vila-Masot | 340/638 |
| 5,012,495 | A * | 4/1991 | Munroe et al. | 337/3 |
| 5,079,530 | A * | 1/1992 | Tsuchiyama | 335/17 |
| 5,157,369 | A * | 10/1992 | Yao | 337/68 |
| 5,491,460 | A * | 2/1996 | Krasser et al. | 337/70 |
| 5,541,569 | A * | 7/1996 | Jang | 337/68 |
| 5,760,672 | A * | 6/1998 | Wang | 337/79 |
| 5,889,457 | A * | 3/1999 | Hsu et al. | 337/59 |
| 6,057,751 | A * | 5/2000 | Hung et al. | 337/377 |
| 6,249,209 | B1 * | 6/2001 | Yu | 337/37 |
| 6,252,490 | B1 * | 6/2001 | Lin | 337/79 |
| 6,275,133 | B1 * | 8/2001 | Chen | 337/37 |
| 6,275,134 | B1 * | 8/2001 | Chen | 337/37 |
| 6,307,459 | B1 * | 10/2001 | Yu | 337/37 |
| 6,335,500 | B1 * | 1/2002 | Chi et al. | 200/341 |
| 6,377,158 | B1 * | 4/2002 | Yu | 337/37 |
| 6,445,273 | B1 * | 9/2002 | Yu | 337/37 |
| 6,445,275 | B2 * | 9/2002 | Yu | 337/68 |
| 6,456,185 | B1 * | 9/2002 | Yu | 337/37 |
| 6,512,441 | B1 * | 1/2003 | Yu | 337/37 |
| 6,542,061 | B2 * | 4/2003 | Santa Cruz et al. | 337/79 |
| 6,552,643 | B2 * | 4/2003 | Chen | 337/66 |
| 6,552,644 | B2 * | 4/2003 | Yu | 337/66 |
| 6,563,414 | B2 * | 5/2003 | Yu | 337/66 |
| 6,570,480 | B1 * | 5/2003 | Huang | 337/79 |
| 6,674,034 | B1 * | 1/2004 | Wang | 200/341 |
| 7,230,516 | B2 * | 6/2007 | Yu | 337/66 |
| 7,336,149 | B2 * | 2/2008 | Ullermann | 337/66 |
| 2006/0186984 | A1 * | 8/2006 | Ullermann | 337/14 |
| 2009/0251836 | A1 * | 10/2009 | Jonsson | 361/93.1 |

* cited by examiner

*Primary Examiner*—Ross N Gushi

(57) ABSTRACT

A warning device for a circuit breaker includes a casing with a button and a warning light is received in the button. The button is movable relative to the casing and made of transparent or translucent material. When the main circuit is connected, the warning light is not activated. When overheat or overload, the main circuit is cut off and a weak current circuit is formed to light up the warning light.

9 Claims, 9 Drawing Sheets

WARNING DEVICE FOR CIRCUIT BREAKER

BACKGROUND OF THE INVENTION

1. Field of the Invention

The present invention relates generally to a warning device for a circuit breaker, and in particular to a warning device to inform the users about the circuit being cut off by activating a warning light.

2. The Prior Arts

A conventional circuit breaker generally includes a bi-metallic plate which bends toward one direction during overflow of the current so as to separate two contact points to cut off the circuit to protect the electric appliance from being burned.

The first shortcoming of the conventional circuit breaker is that it lacks a warning device to inform the users that the circuit is in abnormal status. The conventional circuit breaker can only cut off the circuit but the users cannot tell which appliance is not in function. The second shortcoming of the conventional circuit breaker is that if there are multiple circuits are involved and one of which is cut off, the users have to spend significant time to figure out which circuit is cut off.

Therefore it is necessary to provide a warning device for the circuit breaker to overcome the disadvantages of the conventional circuit breaker.

SUMMARY OF THE INVENTION

A primary objective of the present invention is to provide a warning device to solve the inherent shortcoming that the users cannot tell which circuit or appliance is in trouble and there will be not any obvious signal can be provided to inform the situation about the situation.

A warning device for a circuit breaker according to the present invention includes a casing, a button connected to the casing and a warning light received in the button. The button is movable relative to the casing and made of transparent or translucent material. When the main circuit is connected, the warning light is not activated. When overheat or overflow, the main circuit is cut off and a weak current circuit is formed to light up the warning light to inform the users that the main circuit is cut off.

One of advantages of the present invention is that the circuit of the warning light is not connected when the main circuit of the appliance is in "ON" status. Only when the main circuit for the appliance is cut off, the circuit of the warning light is connected to emit the light.

Another advantage of the present invention is that the warning light lights up to inform the users which main circuit is cut off so that the users can quickly remove the problems. The warning device is especially helpful when it is used in multiple circuits. The warning light lights up to inform which circuit is cut off. The users do not need to check the circuits one by one and saves time and have easy management.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
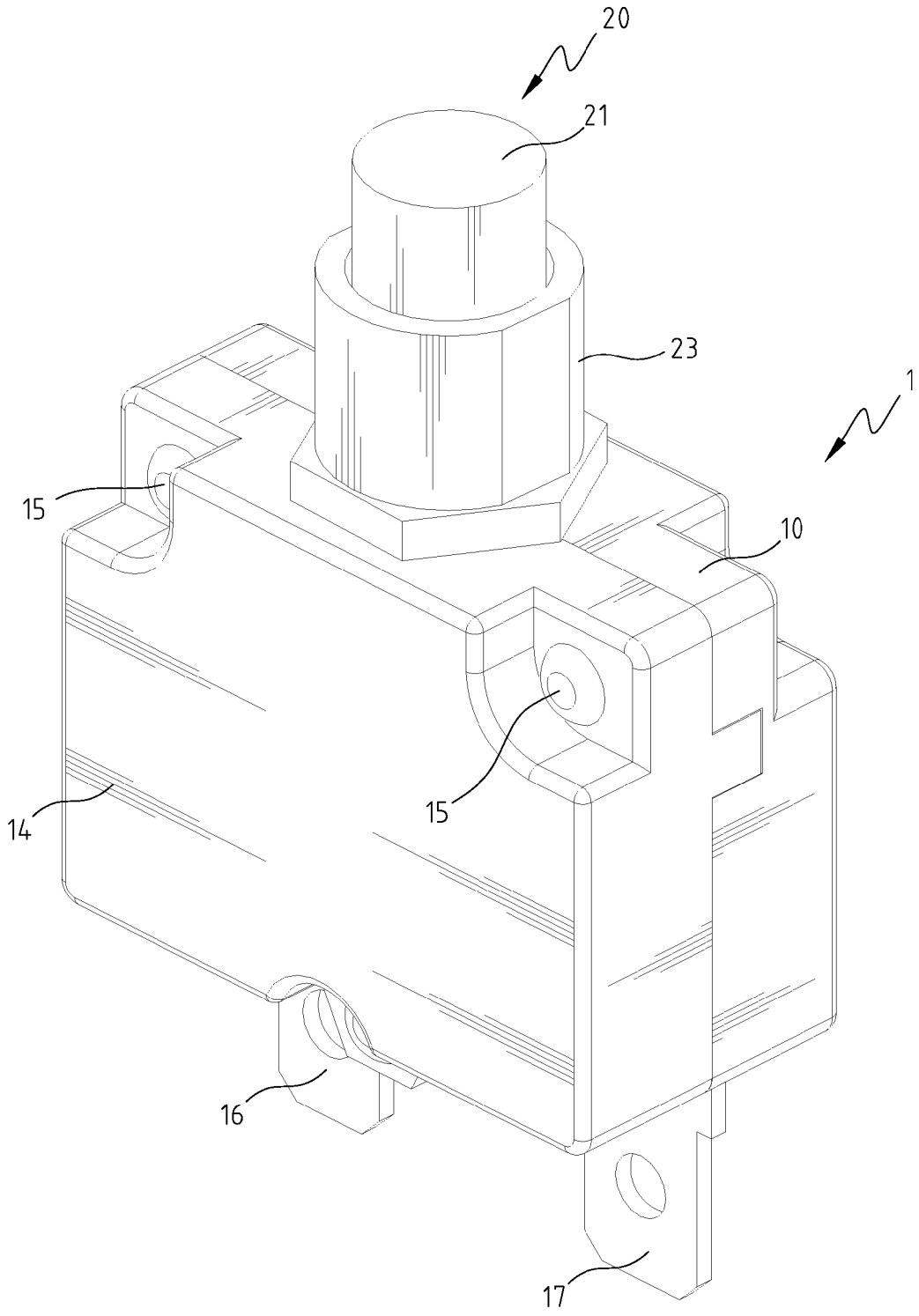
FIG. 1 is a perspective view showing a warning device for a circuit breaker in accordance with the present invention.
Figure 2:
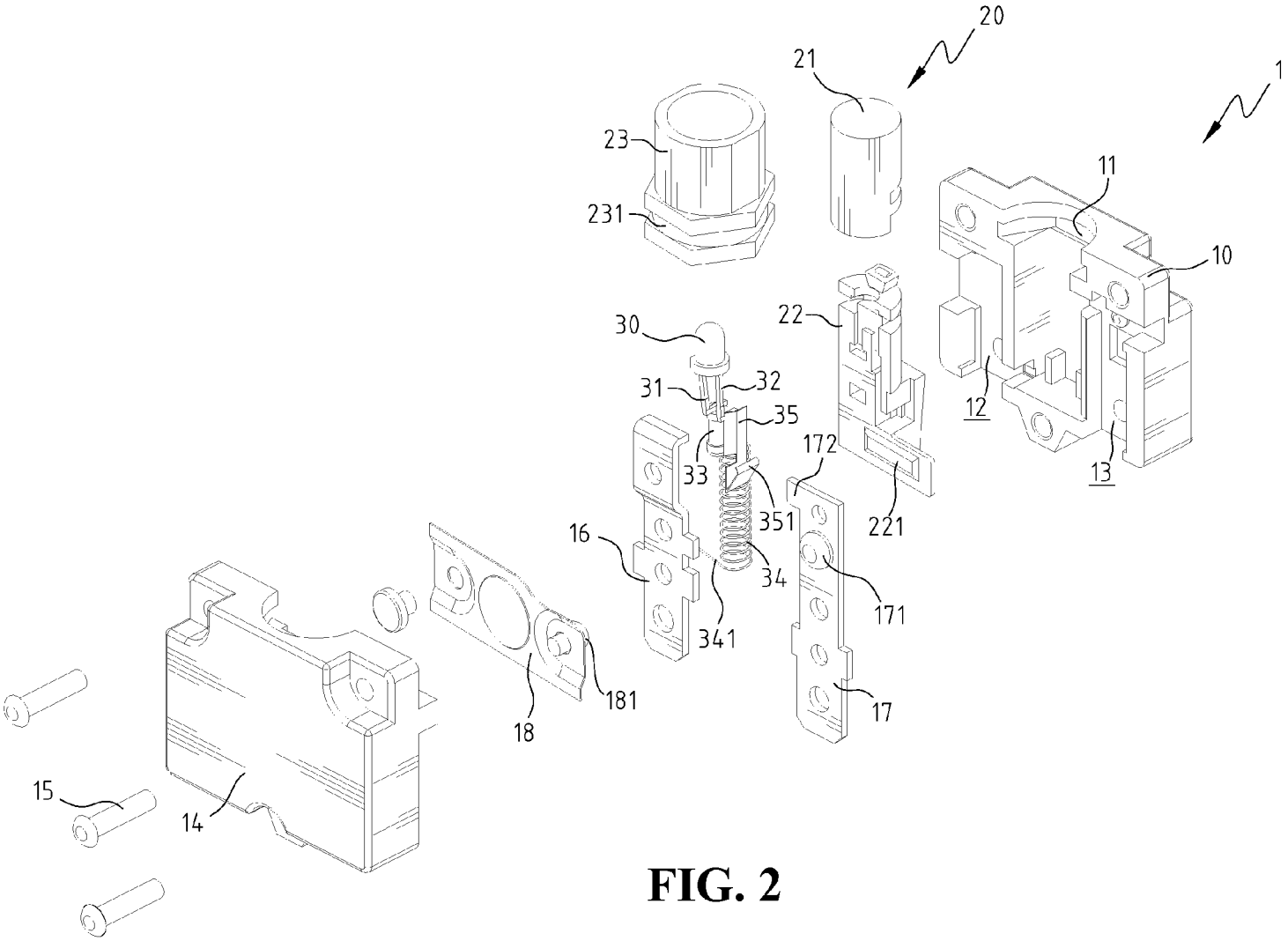
FIG. 2 is an exploded view to show the warning device in accordance with the present invention.
Figure 3:
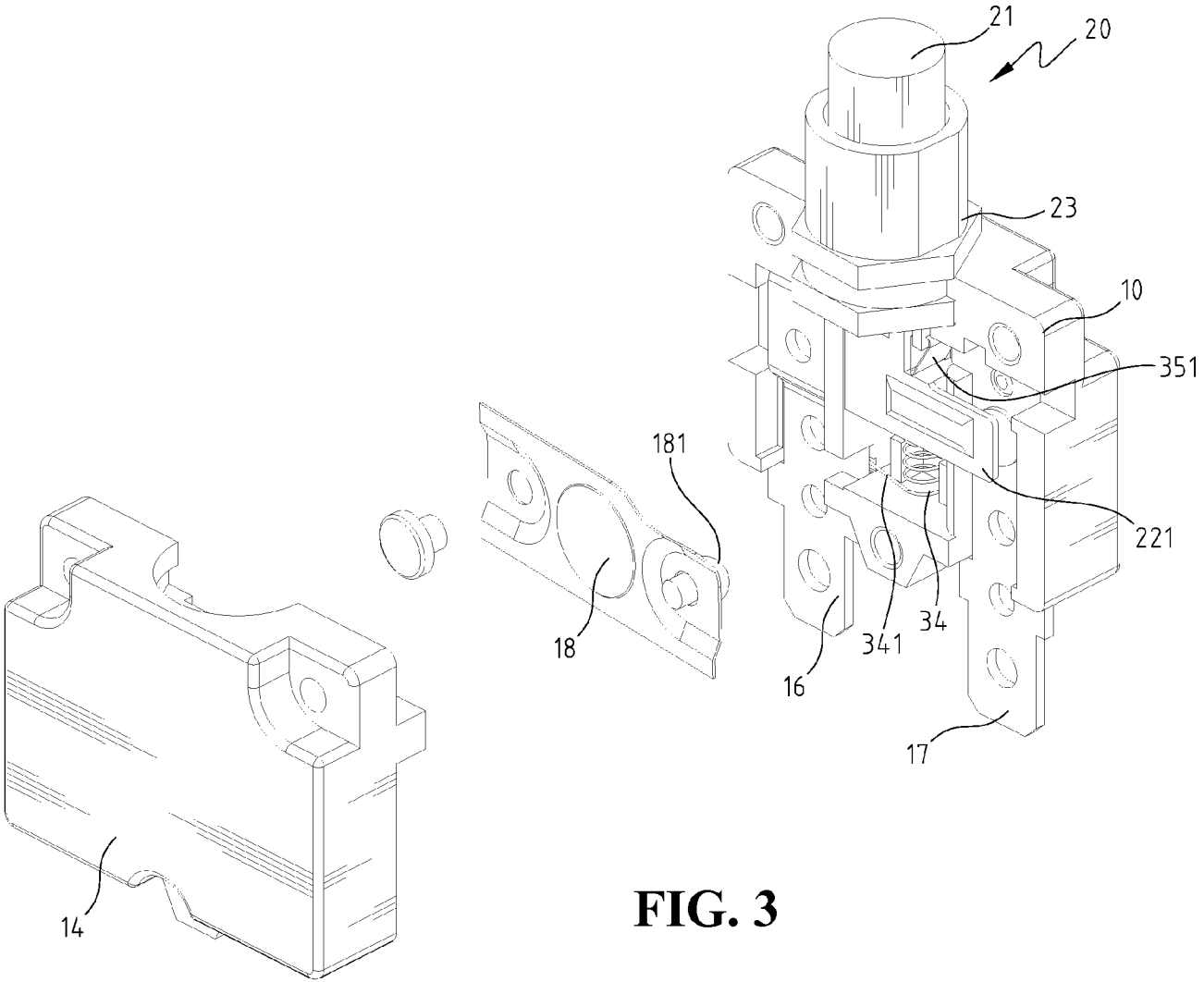
FIG. 3 is an exploded view to show the bi-metallic plate and the warning device of the present invention.

With reference to the drawings in particular to FIGS. 1 to 3, the warning device 1 for a circuit breaker in accordance with the present invention comprises a casing 10, a button 20 and a warning light 30.

The casing 10 is a hollow casing so as to receive parts therein, a recess 11 is defined in the top of the casing 10 and the button 20 is up-and-down movably received in the recess 11. The casing 10 includes a first slot 12 and a second slot 13, and a cover 14 is connected to a rear opening of the casing 10 by bolts 15.

The casing 10 includes at least two terminals. In this embodiment, the terminals include a first terminal 16 and a second terminal 17.

The first terminal 16 extends through the first slot 12 and the second terminal 17 extends through the second slot 13. The second terminal 17 includes a second contact point 171 and an extension portion 172 which extends toward interior of the casing 10. A curved angle is defined in a lower portion of the extension portion 172.

A bi-metallic plate 18 is an elastic strip and slightly curved. The bi-metallic plate 18 has a first end fixed to and electrically connected with an upper end of the first terminal 16, and a second end being a free end. The free end of the bi-metallic plate 18 includes a first contact point 181 which is located corresponding to the second contact point 171. When the bi-metallic plate 18 is heated, it bends to one side. When the bi-metallic plate 18 is cooled, it bends to the other side.

Figure 4:
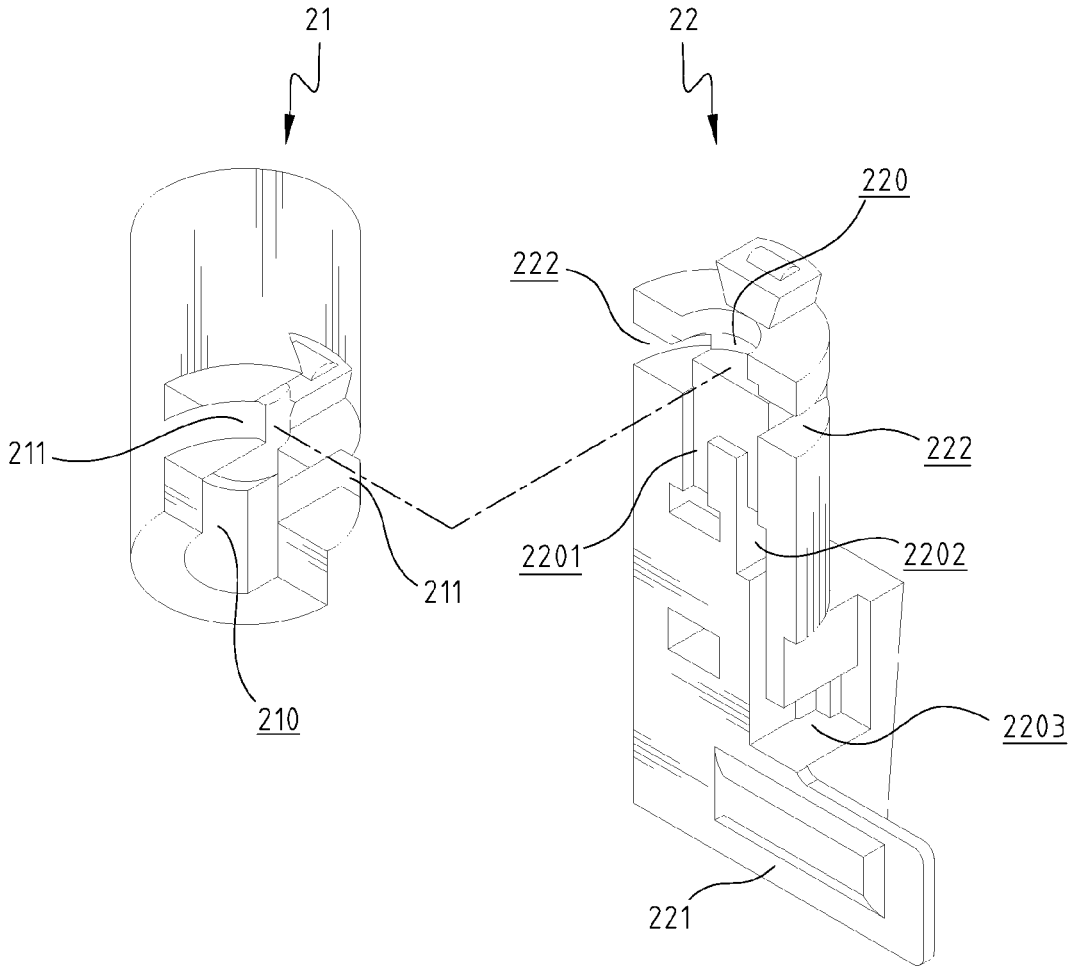
FIG. 4 is an exploded view to show the button of the warning device of the present invention.
Figure 5:
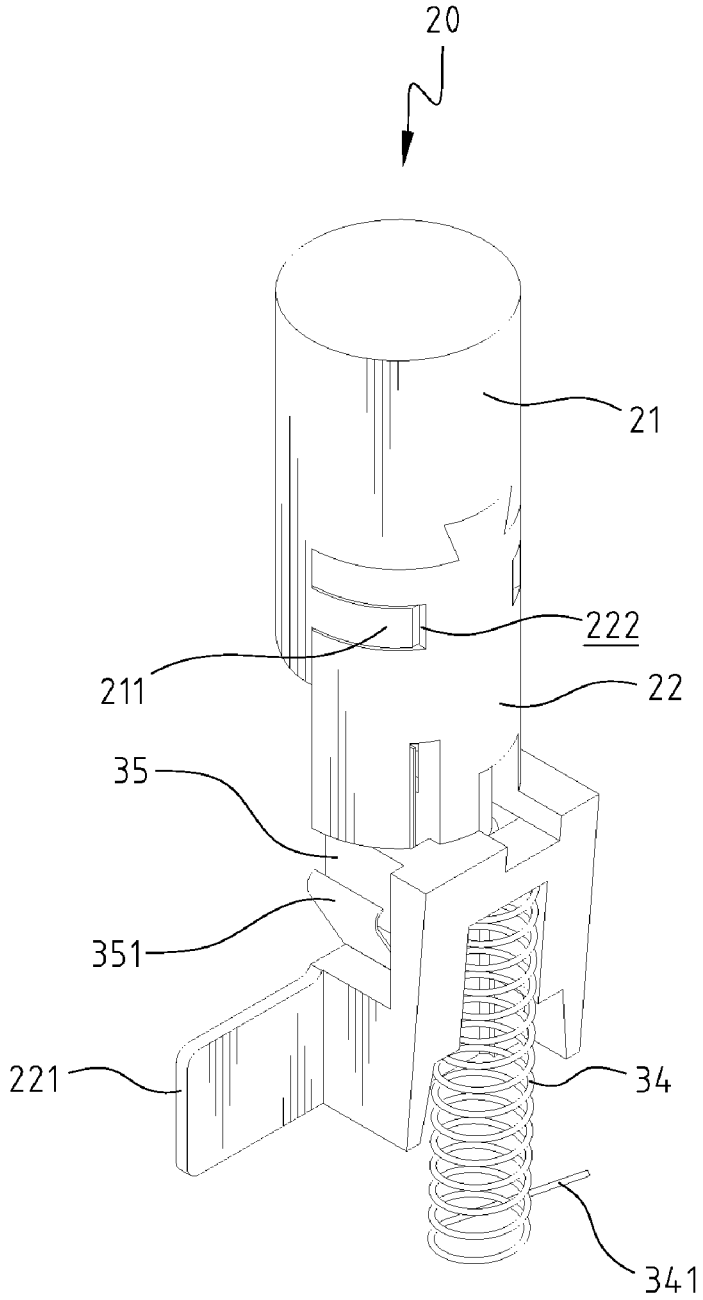
FIG. 5 shows the warning light is received in the button and the resilient member connected to the warning light extends out from the button.

A hollow sleeve 23 is fixed to the casing 10 with its neck portion 231 engaged with the recess 11. The button 20 is received in the sleeve 23 and can be moved through the sleeve 23. In this embodiment, as shown in FIG. 4, the button 20 includes a cap 21 and a shank 22 connected to the cap. The cap 21 is transparent or translucent. The cap 21 of the button 20 includes a reception space 210 in which the warning light 30 is accommodated and at least one protrusion 211 extending from an outside of the reception space 210. The shank 22 includes at least one engaging slot 222 corresponding to the protrusion 211 and a top hole 220. The engaging slot 222 is engaged with the protrusion, and the shank 22 is connected with the cap 21. A first chamber 2201 and a second chamber 2202 are defined in a lower portion of the top hole 220. An opening 2203 is defined at an outside of the shank 22 and communicated with the second chamber 2202. A horizontal cut-off plate 221 is connected to the lower portion of the shank 22. As shown in FIG. 5, there are different ways to connect the cap 21 to the shank 22 such as by snap lugs, hooks or threaded connection.

The warning light 30 is disposed in the reception space 210 of the cap 21. The warning light 30 includes a first leg 31 and a second leg 32. A resistor 33 and a resilient member 34 are arranged and are arranged from the first leg 31 to the first terminal 16 in turn. One end of a connection plate 35 is connected to the second leg 32 and the other end of the connection plate 35 is a free end 351. The free end 351 of the connection plate 35 extends toward the second terminal 17.

The first leg 31, the resistor 33 and the resilient member 34 are located within the first chamber 2201 of the shank 22. The second leg 32 and the connection plate 35 are located within the second chamber 2202 of the shank 22. The free end 351 of the connection plate 35 extends through the opening 2203 as shown in FIG. 5.

In this embodiment, the connection plate 35 is a flexible plate and the free end 351 is a bent portion. The resilient member 34 is a compression spring which provides an upward force to the button 20.

Figure 6A:
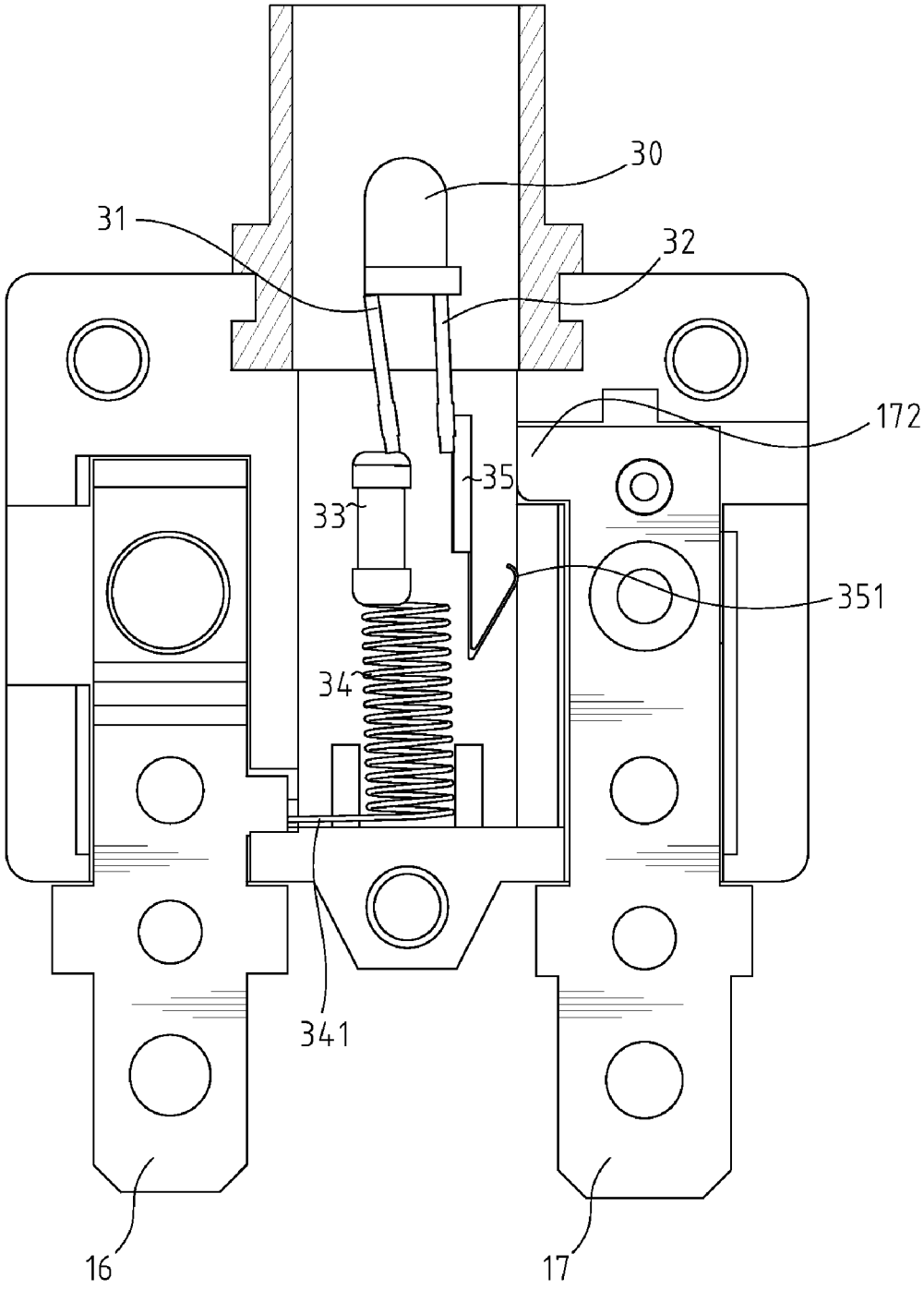
FIG. 6A shows the main circuit is connected and the button is removed for clarity purpose.
Figure 6B:
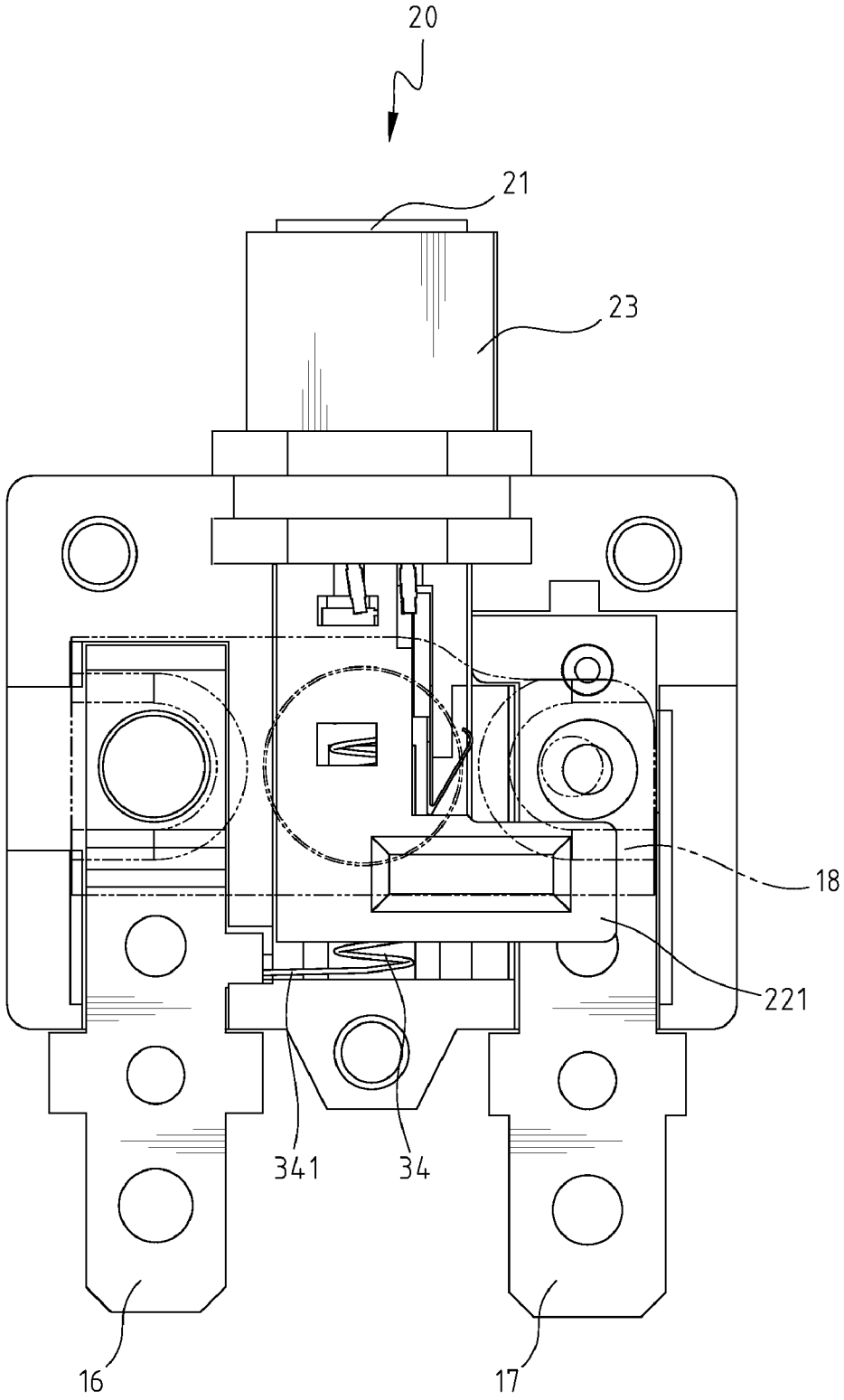
FIG. 6B shows the warning device wherein the main circuit is connected and the button is pushed downward.

Referring to FIGS. 6A and 6B, when the user pushes the button 20 downward, the warning light 30 moves downward and the resilient member 34 is compressed to store the upward force. Before the button 20 is pushed downward, an original position of the insulating cut-off plate 221 is located between the first contact point 181 and the second contact point 171. After the button 20 is pushed downward, the cut-off plate 221 is moved away from the original position between the first and second contact points 181, 171. Then the first contact point 181 pushed by the resilient bi-metallic plate 18 contacts the second contact point 171, thereby a main circuit is formed via the first terminal 16, the bi-metallic plate 18, the first contact point 181, the second contact point 171 and the second terminal 17. In the meanwhile, the free end 351 of the connection plate 35 is separated from the extension portion 172 of the second terminal 17. The circuit for the warning light 30 is cut off so that the warning light 30 is not activated.

Figure 7A:
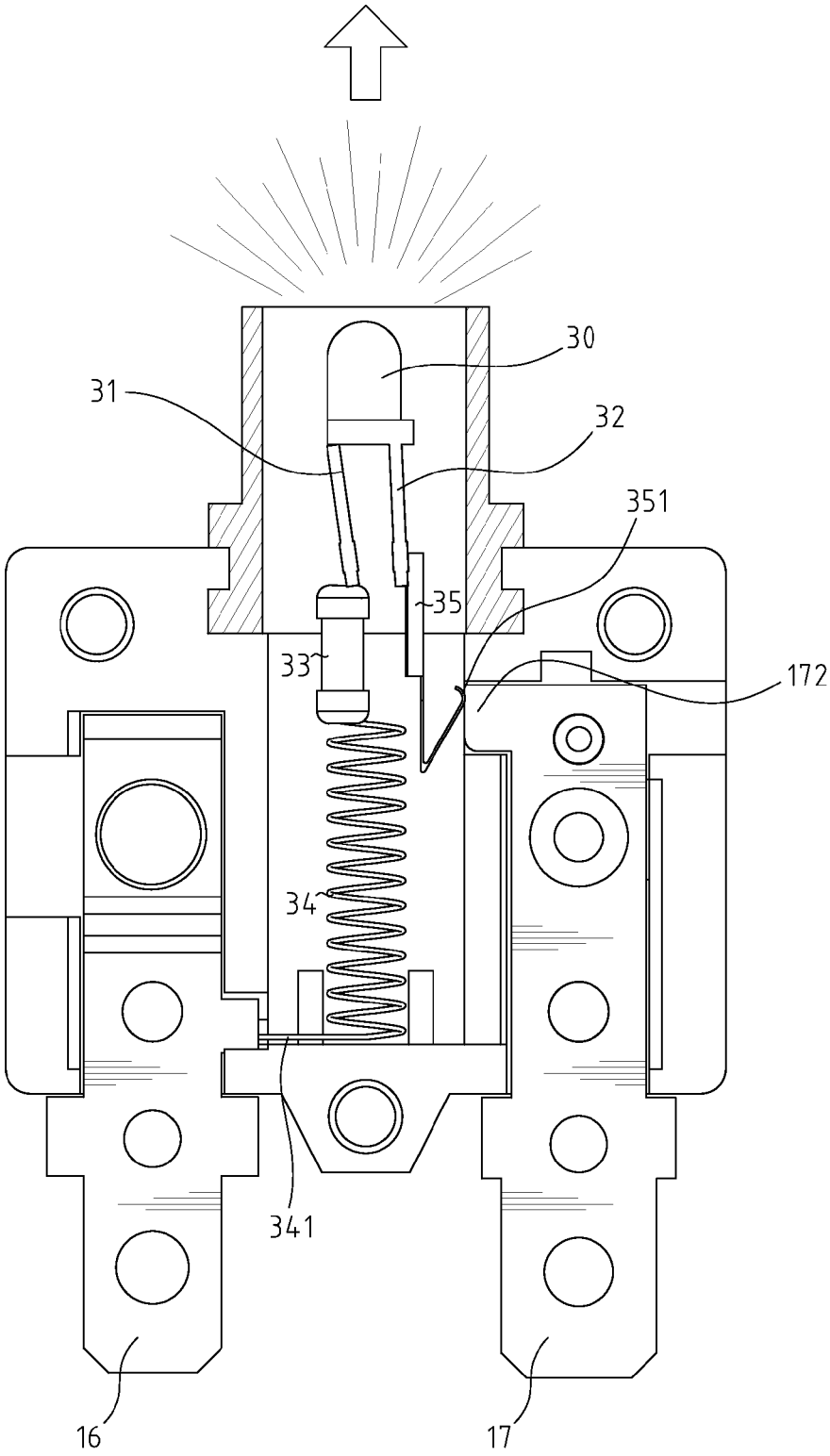
FIG. 7A shows the main circuit is cut off and the warning light lights up, the button is removed for clarity purpose.
Figure 7B:
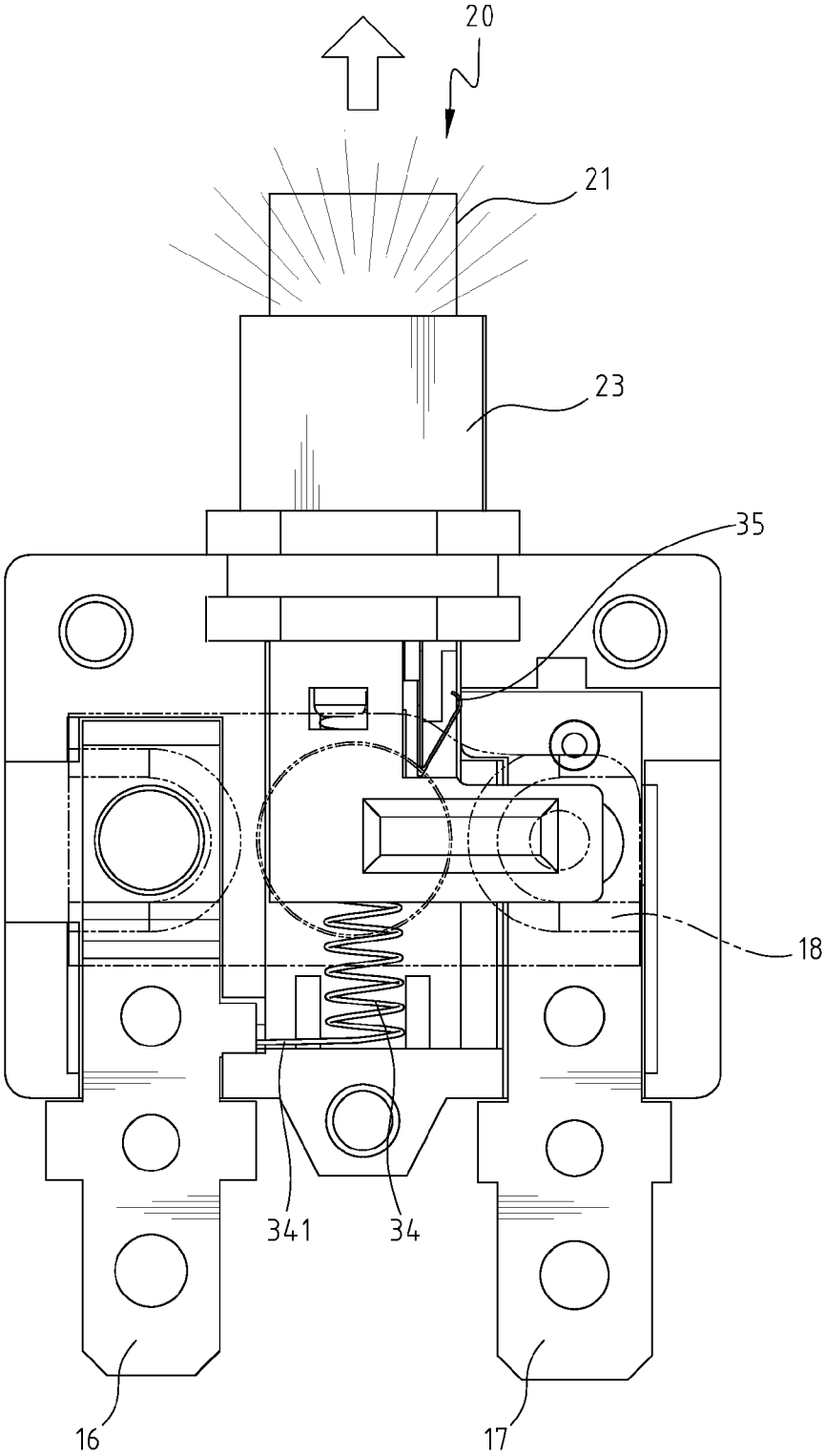
FIG. 7B shows the warning device wherein the main circuit is cut off and the button is moved upward and the warning light lights up.

Referring to FIGS. 7A and 7B, when overheat or overflow, the bi-metallic plate 18 bends to separate the second contact point 171 from the first contact point 181. Thus, the main circuit is cut off. The button 20 and the warning light 30 are pushed by the resilient member 34 and the cut-off plate 221 is moved upward to the position between first and second contact points 181, 171 to cut off the main circuit. In the meanwhile, the free end 351 of the connection plate 35 is in contact with the extension portion 172 of the second terminal 17 to form a weak current via the first terminal 16, an extension end 341 of the resilient member 34, the resilient member 34, the resistor 33, the first leg 31, the warning light 30, the second leg 32, the connection plate 35, the free end 351, the extension portion 172 and the second terminal 17. The warning light 30 activates and the light can be seen via the button 20.

The warning light 30 is not activated when the main circuit is connected. The warning light 30 is activated only when the main circuit is cut off and a weak current is formed. The light signal of the warning light 30 informs the users that the main circuit is abnormal.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A warning device for a circuit breaker, comprising:

a casing;

a button including a cap and a shank connected to the cap, the button movably connected to the casing; and a warning light located within the button and movable with the button, the warning light having a first leg and a second leg, a resistor and a resilient member connected to the first leg, a connection plate connected to the second leg, the resilient member electrically connected to a main circuit and providing an upward force to the button and the warning light when being compressed;

wherein when the main circuit is connected, the connection plate does not connect the main circuit and the warning light is not activated, when overheat or overload, the main circuit is cut off and a weak current circuit is formed via the resilient member, the resistor, the warning light and the connection plate, the warning light lights up.

2. The warning device as claimed in claim 1, wherein the casing comprises a recess, the button is received in a hollow sleeve, the sleeve is fixed to the recess of the casing, the button is up-and-down movable within the sleeve.

3. The warning device as claimed in claim 1, wherein the cap is a transparent or translucent cap.

4. The warning device as claimed in claim 1, wherein the shank includes a top hole, a first chamber and a second chamber are defined in a lower portion of the top hole, an opening defined in an outside of the shank and communicating with the second chamber;

one end of the connection plate is connected with the second leg and the other end of the connection is a free end;

the first leg, the resistor and the resilient member are located within the first chamber of the shank, the second leg and the connection plate are located within the second chamber of the shank, the free end of the connection plate extends through the opening.

5. The warning device as claimed in claim 1, wherein the resilient member is a compression spring.

6. The warning device as claimed in claim 1, wherein the cap includes a first screw thread and the shank includes a second screw thread corresponding to the first screw thread, the cap and the shank is connected by the first screw thread and the second screw thread.

7. The warning device as claimed in claim 1, wherein the cap includes a hook and the shank includes a hole corresponding to the hook, the cap and the shank is connected by the hook and the hole.

8. The warning device as claimed in claim 1, wherein the cap includes a reception space in which the warning light is accommodated.

9. The warning device as claimed in claim 8, wherein the cap includes a protrusion extending from an outside of the reception space of the cap, and the shank includes an engaging slot with which the protrusion is engaged.

* * * * *